US011780064B2

(12) United States Patent
Hsieh

(10) Patent No.: US 11,780,064 B2
(45) Date of Patent: Oct. 10, 2023

(54) SOCKET STRUCTURE

(71) Applicant: KABO Tool Company, Taichung (TW)

(72) Inventor: Chih-Ching Hsieh, Taichung (TW)

(73) Assignee: KABO Tool Company, Taichung (TW)

( * ) Notice: Subject to any disclaimer, the term of this patent is extended or adjusted under 35 U.S.C. 154(b) by 89 days.

(21) Appl. No.: 17/648,813

(22) Filed: Jan. 25, 2022

(65) Prior Publication Data

US 2022/0266426 A1 Aug. 25, 2022

(30) Foreign Application Priority Data

Feb. 20, 2021 (TW) ..... 110105954

(51) Int. Cl.
*B25B 23/00* (2006.01)
*B25B 21/00* (2006.01)

(52) U.S. Cl.
CPC ..... *B25B 23/0035* (2013.01); *B25B 21/00* (2013.01)

(58) Field of Classification Search
CPC ..... B25B 23/0035; B25B 21/00; B25B 13/02; B25B 13/06; B25B 13/10; B25B 13/24; B25B 23/08; B25B 23/10; B25B 13/065; B25B 13/04; B25B 13/08; B25B 13/462; B25B 23/108; Y10T 279/17; Y10T 279/17786; G09F 3/00
USPC ..... 81/438, 119–124.1, 125, 54, 124.6; 269/49
See application file for complete search history.

(56) References Cited

U.S. PATENT DOCUMENTS 7,752,946 B2 * 7/2010 Wang ..... B25B 23/108 81/125
8,579,151 B2 * 11/2013 Kodama ..... B60R 7/04 312/297
8,984,992 B2 * 3/2015 Newkirk ..... B25B 13/06 81/125
9,452,516 B2 * 9/2016 Alavi ..... B25B 15/008
2007/0227311 A1 * 10/2007 Wang ..... B25B 23/108 81/125

FOREIGN PATENT DOCUMENTS

EP 2390058 A2 * 11/2011 ..... B25B 13/06

* cited by examiner

*Primary Examiner* — Don M Anderson
*Assistant Examiner* — Jason Khalil Hawkins
(74) *Attorney, Agent, or Firm* — Wang Law Firm, Inc.

(57) ABSTRACT

A socket structure includes a body, a first fitting hole, a second fitting hole, and at least one elastic engaging member. The first fitting hole is disposed at one end of the body. The second fitting hole is disposed at another end of the body. The at least one elastic engaging member is disposed in the first fitting hole and protrudes toward an inner portion of the first fitting hole along a radial direction of the first fitting hole. When a tool is inserted into the first fitting hole, the at least one elastic engaging member is pressed and deformed by the tool and is thus engaged with the tool. The configuration of the at least one elastic engaging member makes it easier to connect a tool to and remove the tool from the socket structure.

10 Claims, 9 Drawing Sheets

SOCKET STRUCTURE

BACKGROUND OF THE INVENTION

1. Technical Field

The present invention relates to a socket structure and more particularly to a socket structure configured to enable adaptive use of tools.

2. Description of Related Art

Threaded fasteners such as screws and nuts use the friction between screw threads to couple parts that need to be fixed together. Unlike an adhesive bond provided by super glue, airtight adhesive, or the like, threaded fasteners allow parts coupled thereby to be separated with a tool but without damaging the appearance or structure of the parts. As the coupling force of threaded fasteners can be so great that fastening and unfastening with bare hands are impossible, a threaded fastener like a screw generally has a structure for engaging with a tool (e.g., a wrench or screwdriver) that has a corresponding engaging structure and can be used to greatly increase the moment applied by the user so as to reduce the force and operation time required to tighten or loosen the threaded fastener.

With the diversification of parts, the aforesaid engaging structure of threaded fasteners has also developed into different configurations to meet the requirements of different applications. For example, a hexagonal recess sunken into a threaded fastener allows parts coupled thereby to stay visually pleasant in the coupled state, and a threaded fastener with a polygonal external contour can be tightened and loosened with ease. When the parts to be coupled together require different kinds of threaded fasteners, it is necessary to prepare all the corresponding tools in advance. Should a tool of any of the required specifications be lacking, the intended coupling operation cannot be completed. To reduce the burden of having to carry a large number of tools around, socket adapters were developed to allow a user to switch the tool to be used with such an adapter. For example, a socket adapter may have at one end a fitting hole matching, and connectable with, a pneumatic tool and have the opposite end connectable with a tool that does not have a socket, such as a wrench or screwdriver, in order for the pneumatic tool to drive the wrench or screwdriver into rotation. Generally, a socket adapter is detachably coupled to a tool via a fitting structure, and in order to ensure that the socket adapter and the tool can be tightly coupled together, some manufacturers employ a spring-and-steel-ball-based position-limiting structure in the fitting hole of the socket adapter so that the position of the tool can be limited by the spring pushing the steel ball. If, however, the tool does not have a groove where the steel ball can be positioned, the position-limiting effect will rely on point contact, which is disadvantageous in that the tool may get loose easily.

In light of the above, it has been a goal for those involved in the related industries to improve the existing socket structures and thereby increase the convenience of adapting a tool to different uses.

BRIEF SUMMARY OF THE INVENTION

According to an embodiment of the present invention, a socket structure includes a body, a first fitting hole, a second fitting hole, and at least one elastic engaging member. The first fitting hole is disposed at one end of the body. The second fitting hole is disposed at another end of the body. The at least one elastic engaging member is disposed in the first fitting hole and protrudes toward an inner portion of the first fitting hole along a radial direction of the first fitting hole. When a tool is inserted into the first fitting hole, the at least one elastic engaging member is pressed and deformed by the tool and is thus engaged with the tool.

The configuration of the at least one elastic engaging member makes it easier to adapt a tool to different uses.

The foregoing socket structure may further include at least one receiving hole. The at least one receiving hole is in communication with the first fitting hole and is where the at least one elastic engaging member is disposed.

In the foregoing socket structure, the at least one receiving hole includes a large-diameter section and a small-diameter section connected to the large-diameter section, and the at least one elastic engaging member includes a head portion, a neck portion, and an engaging portion. The head portion is disposed in the large-diameter section. The neck portion is connected to the head portion and is disposed in the small-diameter section. The engaging portion is connected to the neck portion and protrudes toward the inner portion of the first fitting hole along the radial direction of the first fitting hole. Moreover, the engaging portion has a first cross section whose area is larger than the area of a second cross section of the neck portion.

In the foregoing socket structure, the first cross section of the engaging portion is generally elliptical and includes a major axis and a minor axis. The major axis is parallel to an axial direction of the first fitting hole. The minor axis is perpendicular to the major axis.

In the foregoing socket structure, the at least one elastic engaging member may further include a through hole and a chamfer. The through hole is disposed in the engaging portion. The chamber is disposed at the end of the engaging portion that faces away from the head portion.

In the foregoing socket structure, the engaging portion may be generally semispherical.

In the foregoing socket structure, the head portion may protrude from the outer surface of the body along the radial direction of the first fitting hole.

In the foregoing socket structure, the number of the at least one receiving hole and the number of the at least one elastic engaging member may be three. The three receiving holes are disposed at intervals along the periphery of the first fitting hole and extend along radial directions of the first fitting hole respectively. The three elastic engaging members are disposed in the three receiving holes respectively.

In the foregoing socket structure, each receiving hole is spaced apart from an end edge of the body by a distance in the axial direction of the first fitting hole, and the aforesaid distances are different.

The foregoing socket structure may further include a collar mounted around the body and connected with the at least one elastic engaging member.

DETAILED DESCRIPTION OF THE INVENTION

Figure 1:
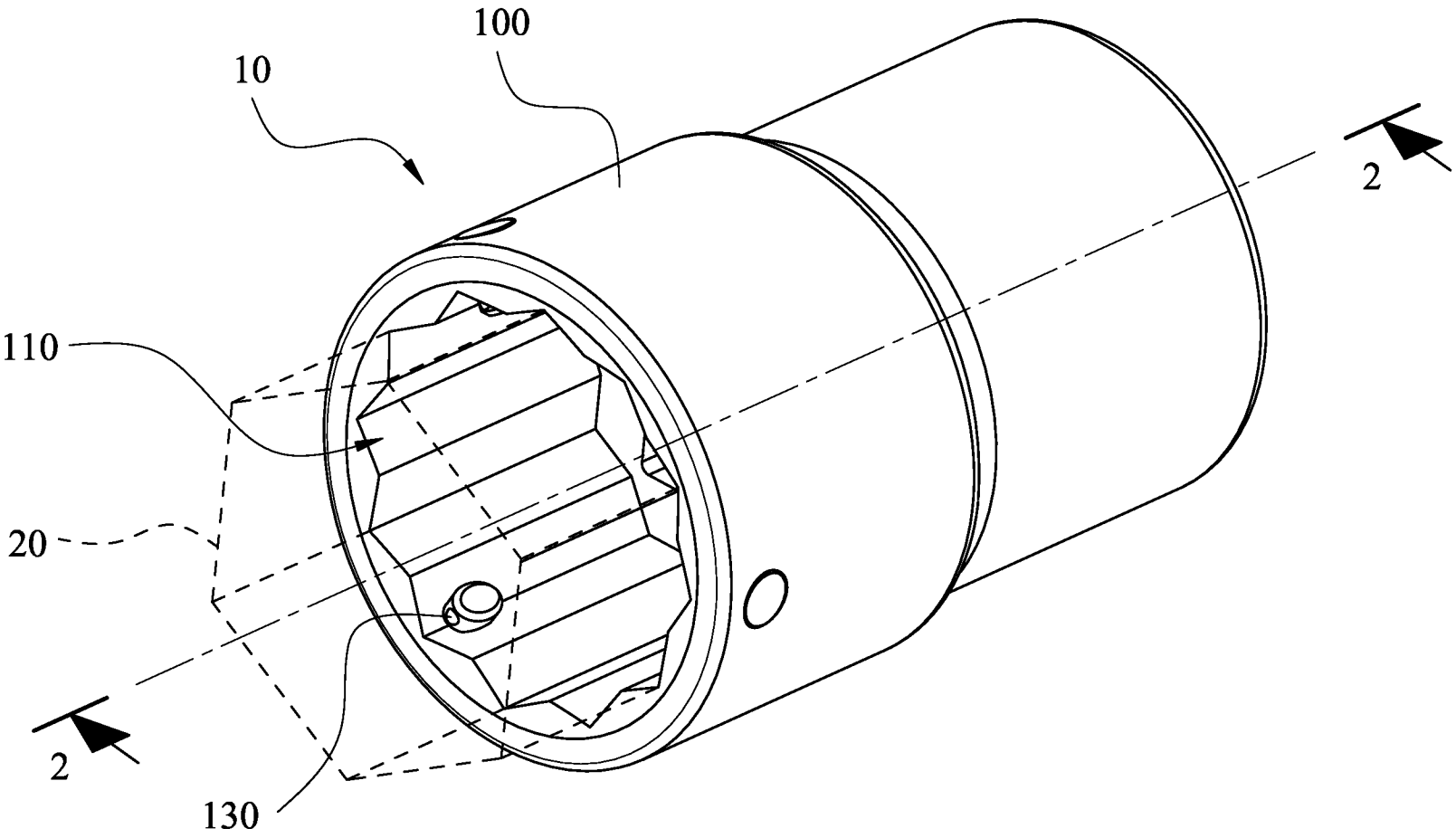
FIG. 1 is a perspective view of the socket structure according to a first embodiment of the present invention, showing the socket structure connected to a tool.

A number of embodiments of the present invention will be described below with reference to the accompanying drawings. The following description will include many practical details in order to be clear and specific. The reader, however, should understand that those practical details are not intended to be restrictive of the scope of the invention; in other words, the practical details are not essential to some embodiments of the invention. Besides, for the sake of simplicity of the drawings, some conventional or commonly used structures and elements are drawn only schematically in the drawings, and repeated elements may be indicated by the same reference numeral or similar reference numerals.

In addition, when an element (or mechanism or module) is described herein as "connected to", "disposed at", or "coupled to" another element, the first element may be directly connected to, directly disposed at, or directly coupled to the second element, or the first element may be indirectly connected to, indirectly disposed at, or indirectly coupled to the second element, i.e., with another element between the first element and the second element. Only when it is explicitly stated that the first element is "directly connected to", "directly disposed at", or "directly coupled to" the second element will there be no other element between the first element and the second element. Furthermore, terms such as first, second, and third are used only to identify different elements or ingredients but not to limit the elements/ingredients themselves. It is therefore feasible to refer to the first element/ingredient as the second element/ingredient instead. Moreover, the combination of elements/ingredients/mechanisms/modules disclosed herein is not a generally known, routine, or conventional combination in the field to which the invention pertains, so whether the combination relationship disclosed herein can be easily achieved by a person of ordinary skill in the art should not be determined by whether the elements/ingredients/mechanisms/modules themselves are conventional.

Figure 2:
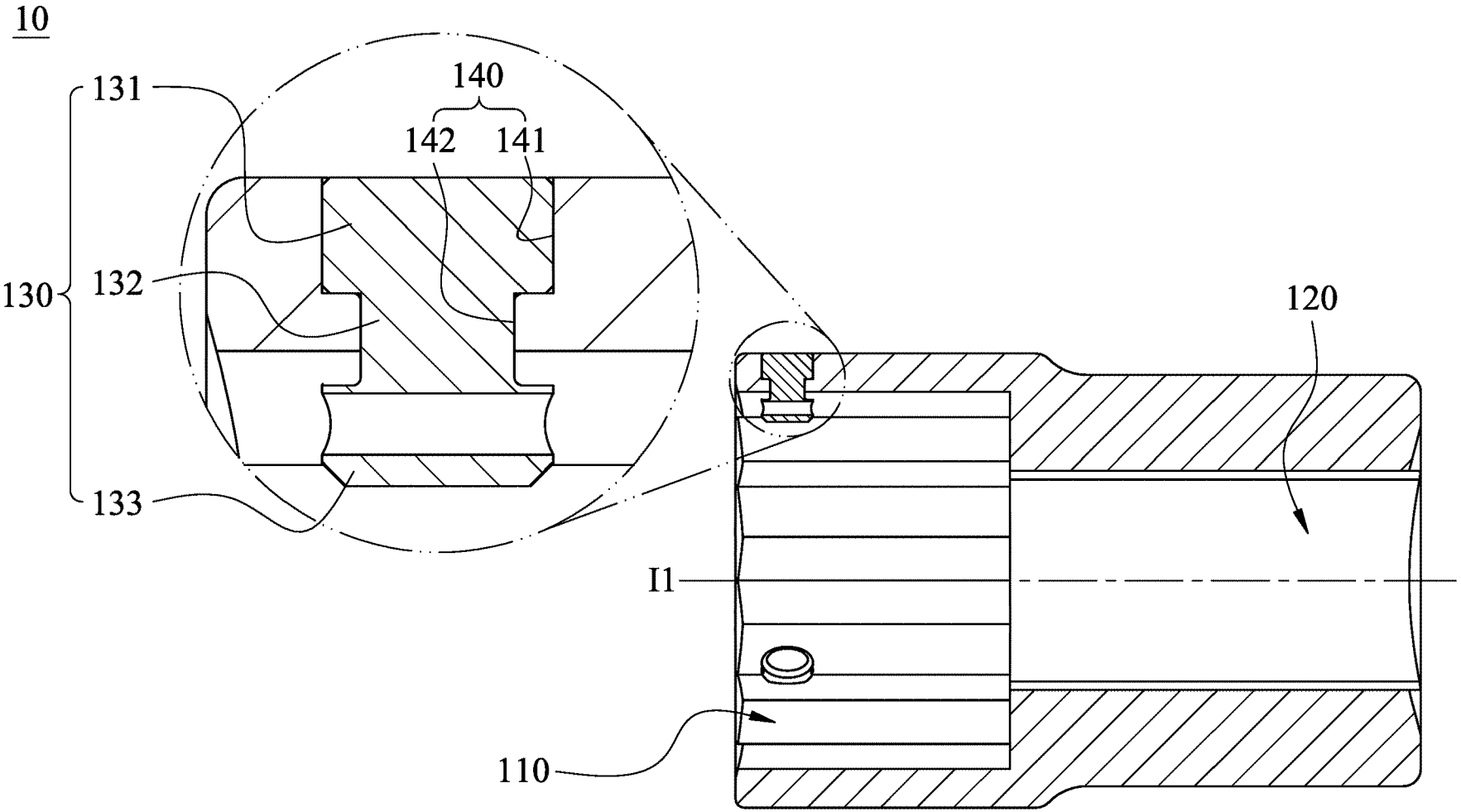
FIG. 2 is a sectional view, taken along line 2-2 in FIG. 1, of the socket structure according to the first embodiment.

Referring to FIG. 1 and FIG. 2, which are respectively a perspective view of the socket structure 10 according to a first embodiment of the present invention, showing the socket structure 10 connected to a tool 20, and a sectional view, taken along line 2-2 in FIG. 1, of the socket structure 10 according to the first embodiment, the socket structure 10 includes a body 100, a first fitting hole 110, a second fitting hole 120, and at least one elastic engaging member 130. The first fitting hole 110 is disposed at one end of the body 100. The second fitting hole 120 is disposed at the opposite end of the body 100. The at least one elastic engaging member 130 is disposed in the first fitting hole 110 and protrudes toward an inner portion of the first fitting hole 110 along a radial direction of the first fitting hole 110. When the tool 20 is inserted into the first fitting hole 110, the at least one elastic engaging member 130 is pressed and deformed by the tool 20 and is thus engaged with the tool 20.

The configuration of the at least one elastic engaging member 130 makes it easier to adapt the tool 20 to different uses.

Figure 3:
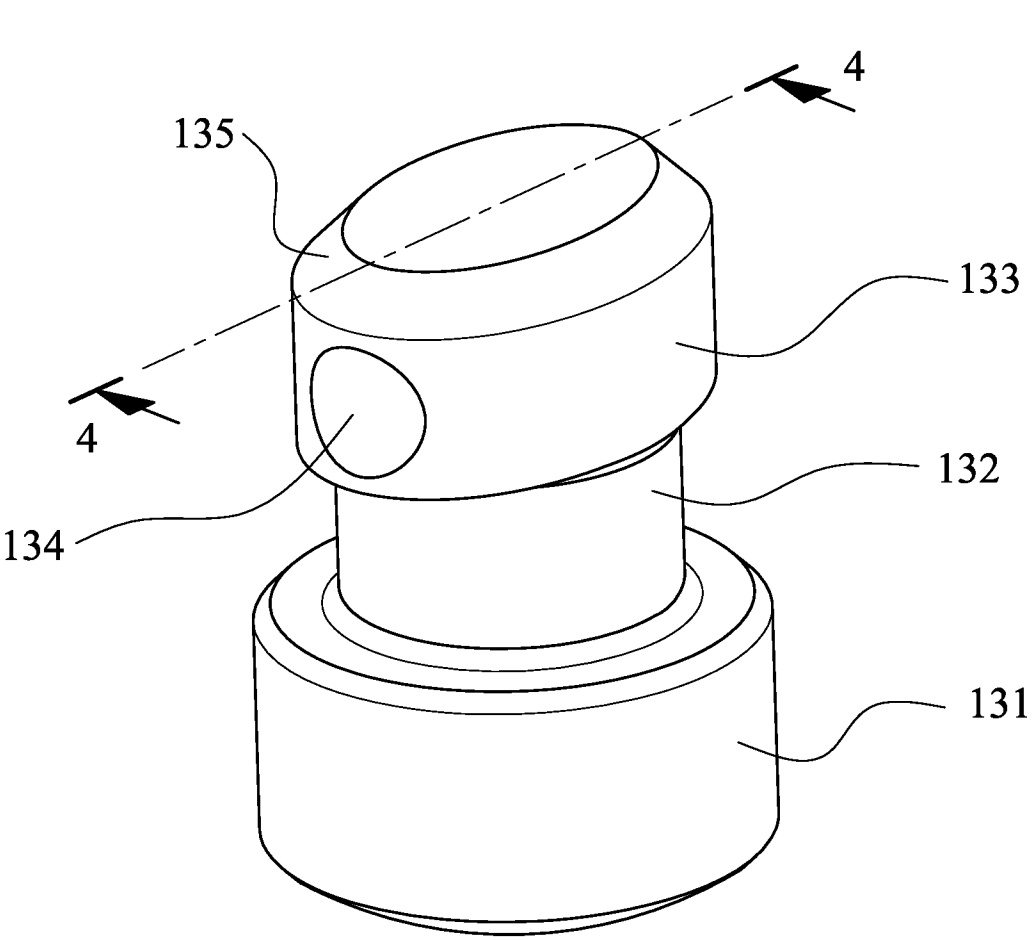
FIG. 3 is a perspective view of an elastic engaging member in the first embodiment as shown in FIG. 1.
Figure 4:
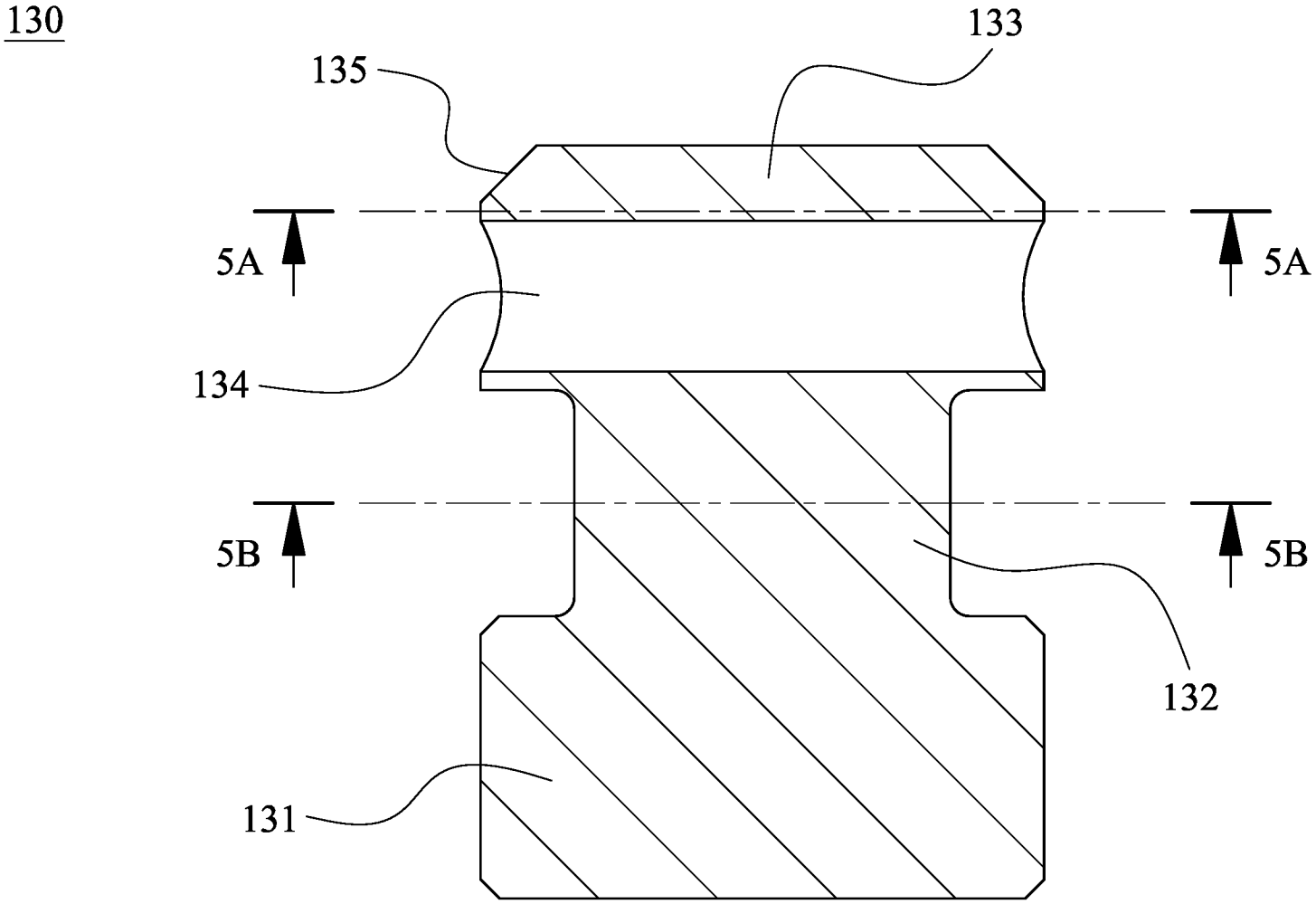
FIG. 4 is a sectional view of the elastic engaging member in FIG. 3, taken along line 4-4.
Figure 5B:
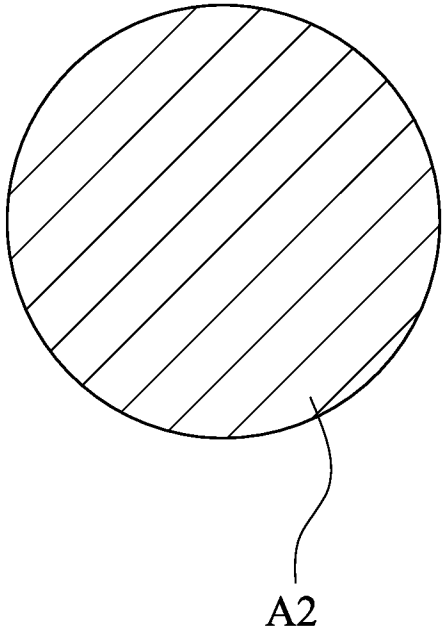
FIG. 5B is another cross-sectional view of the elastic engaging member in FIG. 3, taken along line 5B-5B in FIG. 4.
Figure 5A:
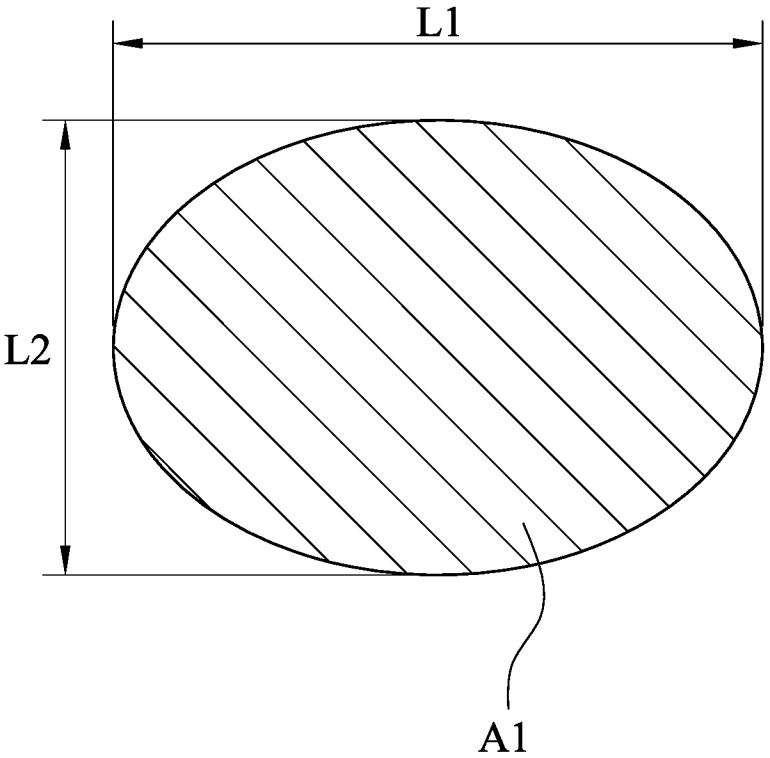
FIG. 5A is a cross-sectional view of the elastic engaging member in FIG. 3, taken along line 5A-5A in FIG. 4.

Reference is now made to FIG. 3, FIG. 4, FIG. 5A, and FIG. 5B in conjunction with FIG. 2, in which FIG. 3 is a perspective view of an elastic engaging member 130 in the first embodiment as shown in FIG. 1; FIG. 4 is a sectional view of the elastic engaging member 130 in FIG. 3, taken along line 4-4; FIG. 5A is a cross-sectional view of the elastic engaging member 130 in FIG. 3, taken along line 5A-5A in FIG. 4; and FIG. 5B is another cross-sectional view of the elastic engaging member 130 in FIG. 3, taken along line 5B-5B in FIG. 4. As can be seen in FIG. 2, the socket structure 10 may further include at least one receiving hole 140. The at least one receiving hole 140 is in communication with the first fitting hole 110 and is where the at least one elastic engaging member 130 is disposed.

More specifically, each receiving hole 140 of the socket structure 10 may include a large-diameter section 141 and a small-diameter section 142 connected to the large-diameter section 141, and as can be seen in FIG. 3, FIG. 4, FIG. 5A, and FIG. 5B, each elastic engaging member 130 may include a head portion 131, a neck portion 132, and an engaging portion 133. The head portion 131 of each elastic engaging member 130 is disposed in the large-diameter section 141 of the corresponding receiving hole 140. The neck portion 132 of each elastic engaging member 130 is connected to the head portion 131 of the elastic engaging member 130 and is disposed in the small-diameter section 142 of the corresponding receiving hole 140. The engaging portion 133 of each elastic engaging member 130 is connected to the neck portion 132 of the elastic engaging member 130 and protrudes toward the inner portion of the first fitting hole 110 along a radial direction of the first fitting hole 110. In each elastic engaging member 130, the engaging portion 133 has a first cross section A1, the neck portion 132 has a second cross section A2, the area of the first cross section A1 is greater than the area of the second cross section A2, and the area of the cross section of the head portion 131 is also greater than the area of the second cross section A2. Therefore, after each elastic engaging member 130 is pressed into and thereby disposed in the corresponding receiving hole 140, the head portion 131 of each elastic engaging member 130 can prevent the elastic engaging member 130 from separating from the corresponding receiving hole 140 and moving toward the inner portion of the first fitting hole 110, and the engaging portion 133 of each elastic engaging member 130 can prevent the elastic engaging member 130 from separating from the corresponding receiving hole 140 and moving toward the outside of the first fitting hole 110. In consequence, each elastic engaging member 130 is securely disposed in the corresponding receiving hole 140. In addition, the relatively large area of the first cross section A1 of each elastic engaging member 130 helps increase the area over which the elastic engaging member 130 engages with the tool 20 when deformed, thereby enhancing the stability with which each elastic engaging member 130 is engaged with the tool 20.

The first cross section A1 of the engaging portion 133 of each elastic engaging member 130 of the socket structure 10 may have a generally elliptical shape and include a major axis L1 and a minor axis L2, with the major axis L1 parallel to an axial direction I1 of the first fitting hole 110, and the minor axis L2 perpendicular to the major axis L1. The second cross section A2 of each elastic engaging member 130 may have a generally circular shape. In other embodiments, the second cross section of the neck portion, as well as the cross section of the head portion, of each elastic engaging member may also be elliptical, with the cross sections of the large- and small-diameter sections of each receiving hole having the corresponding elliptical shapes respectively so that each elastic engaging member cannot be rotated with respect to the receiving hole where it is disposed. The shapes of the aforesaid cross sections, however, are not limited to those described above. Each elastic engaging member 130 may further include a through hole 134 and a chamfer 135, with the through hole 134 disposed in the engaging portion 133, and the chamfer 135 disposed at the end of the engaging portion 133 that faces away from the head portion 131, wherein the through hole 134 may penetrate the engaging portion 133 in the axial direction I1. The structural configurations of the major axis L1, the minor axis L2, and the chamfer 135 are such that while the tool 20 is being inserted into or removed from the first fitting hole 110 in the axial direction I1 of the first fitting hole 110, the resistance between the tool 20 and the engaging portion 133 of each elastic engaging member 130 is reduced. Moreover, the configuration of the through hole 134 in each elastic engaging member 130 helps increase the deformation of the engaging portion 133 of each elastic engaging member 130 and thereby facilitates the docking of the tool 20. In other embodiments, the cross sections of the head portion and neck portion of each elastic engaging member and the cross sections of the large- and small-diameter sections of each receiving hole may have other geometric shapes than those disclosed herein.

In the first embodiment of the present invention, the number of the at least one receiving hole 140 is three, and the three receiving holes 140 are disposed at intervals along the periphery of the first fitting hole 110 and extend along radial directions of the first fitting hole 110 respectively. The number of the at least one elastic engaging member 130 in the first embodiment is also three, and the three elastic engaging members 130 are disposed in the three receiving holes 140 respectively so that the tool 20 can be radially engaged with the three elastic engaging members 130 at the same time. The tool 20, therefore, will be more stable than if there is only one elastic engaging member 130 and be kept from wobbling or separating from the socket structure 10 easily, allowing the force applied by a user to the tool 20 to be transmitted efficiently. The socket structure 10 may additionally include a plurality of engaging teeth (not indicated by a reference numeral in the drawings) disposed in the first fitting hole 110 to further prevent the tool 20 (see FIG. 1) from separating from the first fitting hole 110 when the tool 20 is driven to rotate. In terms of operation, a pneumatic tool (not shown) may be fitted into the second fitting hole 120, and the tool 20 (shown herein as a hex key by way of example) into the first fitting hole 110 so as to be driven into rotation by the pneumatic tool.

Figure 6:
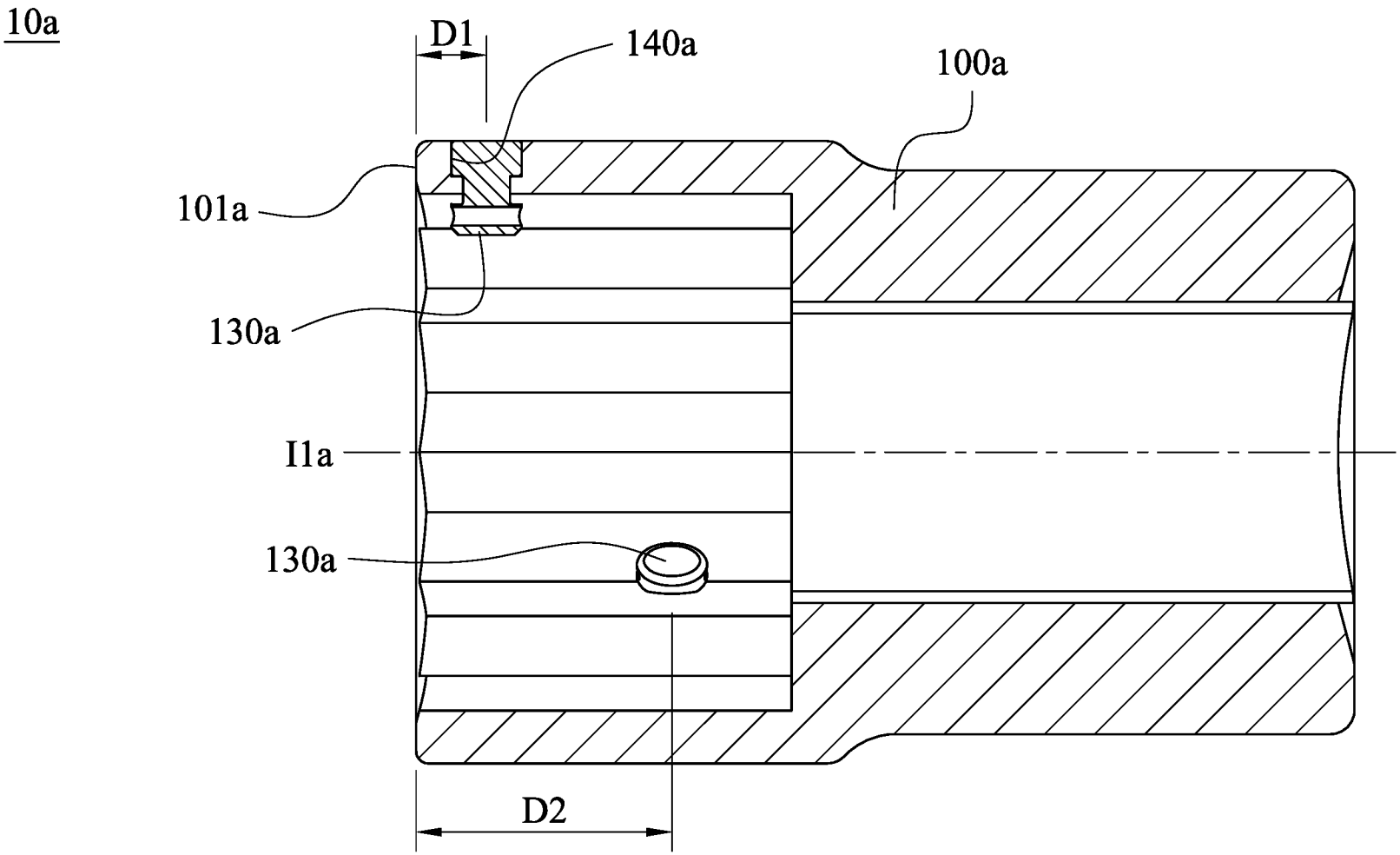
FIG. 6 is a sectional view of the socket structure according to a second embodiment of the invention.

Referring to FIG. 6, which is a sectional view of the socket structure 10*a* according to a second embodiment of the present invention, the socket structure 10*a* is structurally similar to the socket structure 10 according to the first embodiment, the difference being that each receiving hole 140*a* of the socket structure 10*a* may be spaced apart from an end edge 101*a* of the body 100*a* by a different distance in the axial direction Ila. For example, one of the elastic engaging members 130*a* is spaced apart from the end edge 101*a* by a distance D1, and another elastic engaging member 130*a* by a distance D2 different from the distance D1 so that the tool can be engaged with elastic engaging members 130*a* that are respectively located at different positions in the axial direction I1*a*. In other embodiments, the numbers and distributions of the at least one receiving hole and of the at least one elastic engaging member may be changed according to practical needs, without being limited to those disclosed herein.

Figure 7:
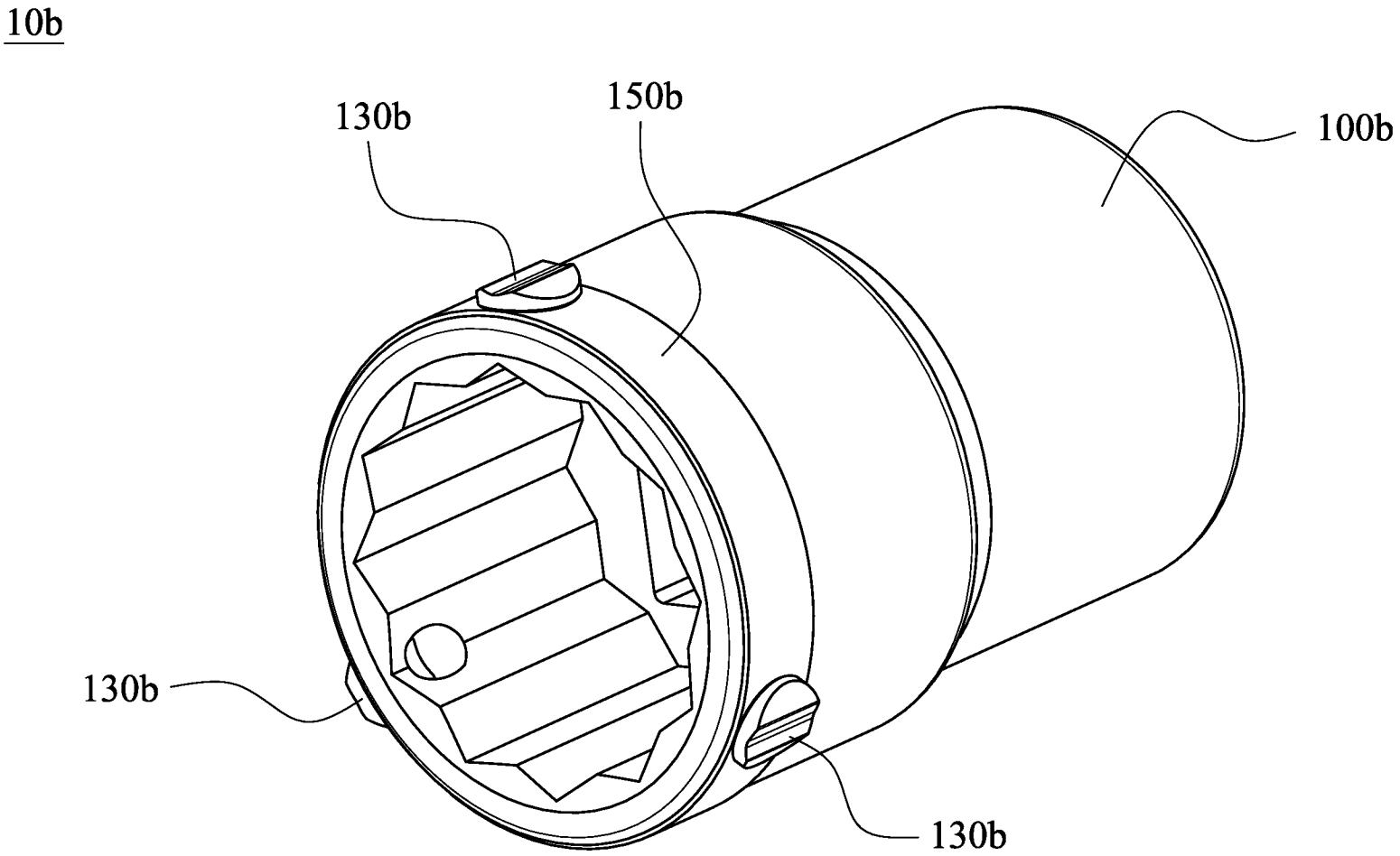
FIG. 7 is a perspective view of the socket structure according to a third embodiment of the invention.
Figure 8:
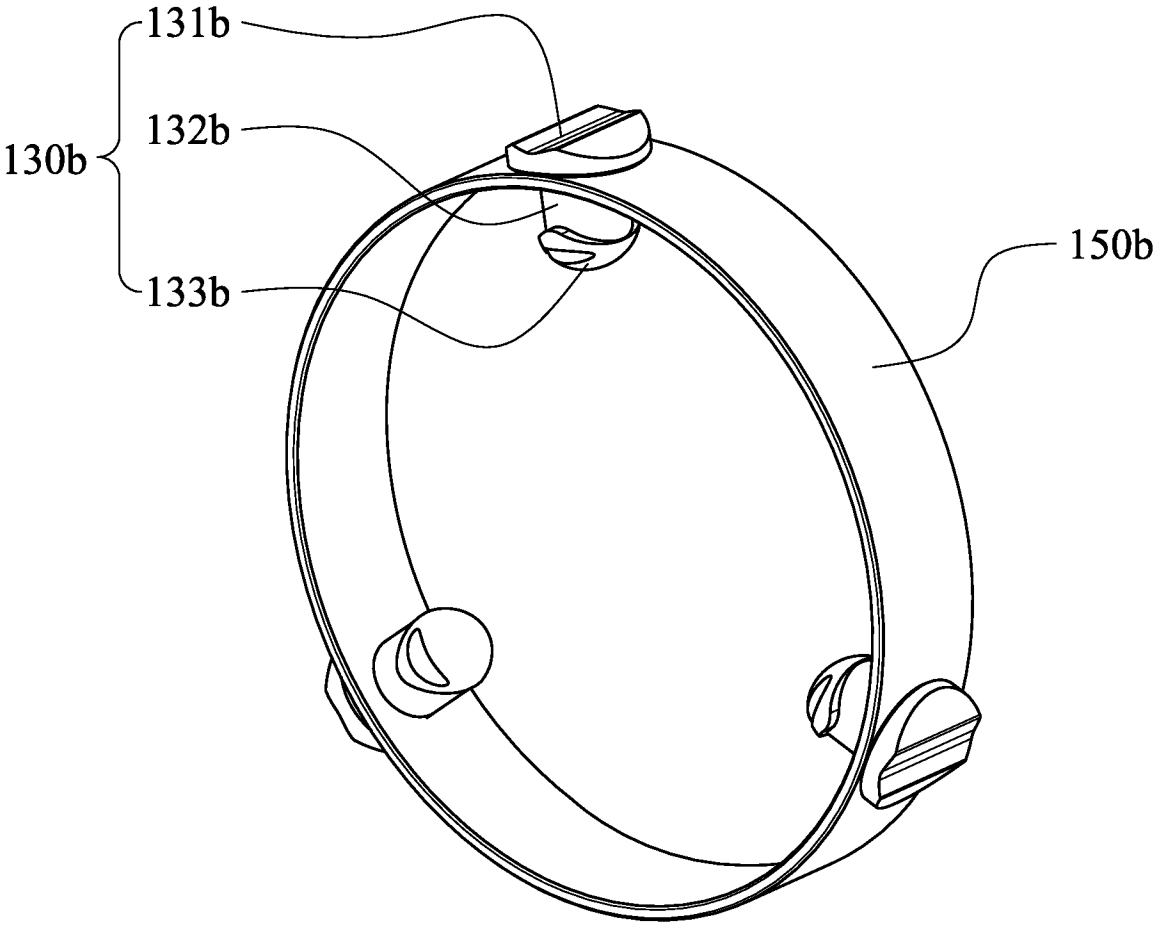
FIG. 8 is a perspective view of the at least one elastic engaging member and the collar in the third embodiment as shown in FIG. 7.

Referring to FIG. 7 for a perspective view of the socket structure 10*b* according to a third embodiment of the present invention, and FIG. 8 for a perspective view of the at least one elastic engaging member 130*b* and the collar 150*b* in the third embodiment as shown in FIG. 7, the socket structure 10*b* according to the third embodiment is similar to the socket structure 10 according to the first embodiment but further includes the collar 150*b*. The collar 150*b* is mounted around the body 100*b* and is connected with the at least one elastic engaging member 130*b*. The collar 150*b* may be connected to a portion of the at least one elastic engaging member 130*b* that lies between the head portion 131*b* and the neck portion 132*b*. In the third embodiment, the collar 150*b* and the at least one elastic engaging member 130*b* may also be integrally formed, and it is the elasticity of the collar 150*b* and of the at least one elastic engaging member 130*b* that allows the collar 150*b* to be mounted around the body 100*b*, and each elastic engaging member 130*b* to be pressed into the corresponding receiving hole (not indicated by a reference numeral in FIG. 7 or FIG. 8) until the engaging portion 133*b* of the elastic engaging member 130*b* extends into the inner portion of the first fitting hole (not indicated by a reference numeral in FIG. 7 or FIG. 8) to prevent the elastic engaging member 130*b* from being removed from the corresponding receiving hole easily. In other embodiments, the collar may also include through bores into which elastic engaging members can be inserted respectively. In that case, the assembly process will include mounting the collar around the body and then passing the engaging portion and neck portion of each elastic engaging member through the corresponding through bore such that the neck portion of each elastic engaging member is disposed in the corresponding receiving hole while the engaging portion extends into the inner portion of the first fitting hole. Each elastic engaging member as well as the collar, therefore, can be separately detached for replacement, depending on their use conditions.

Figure 9:
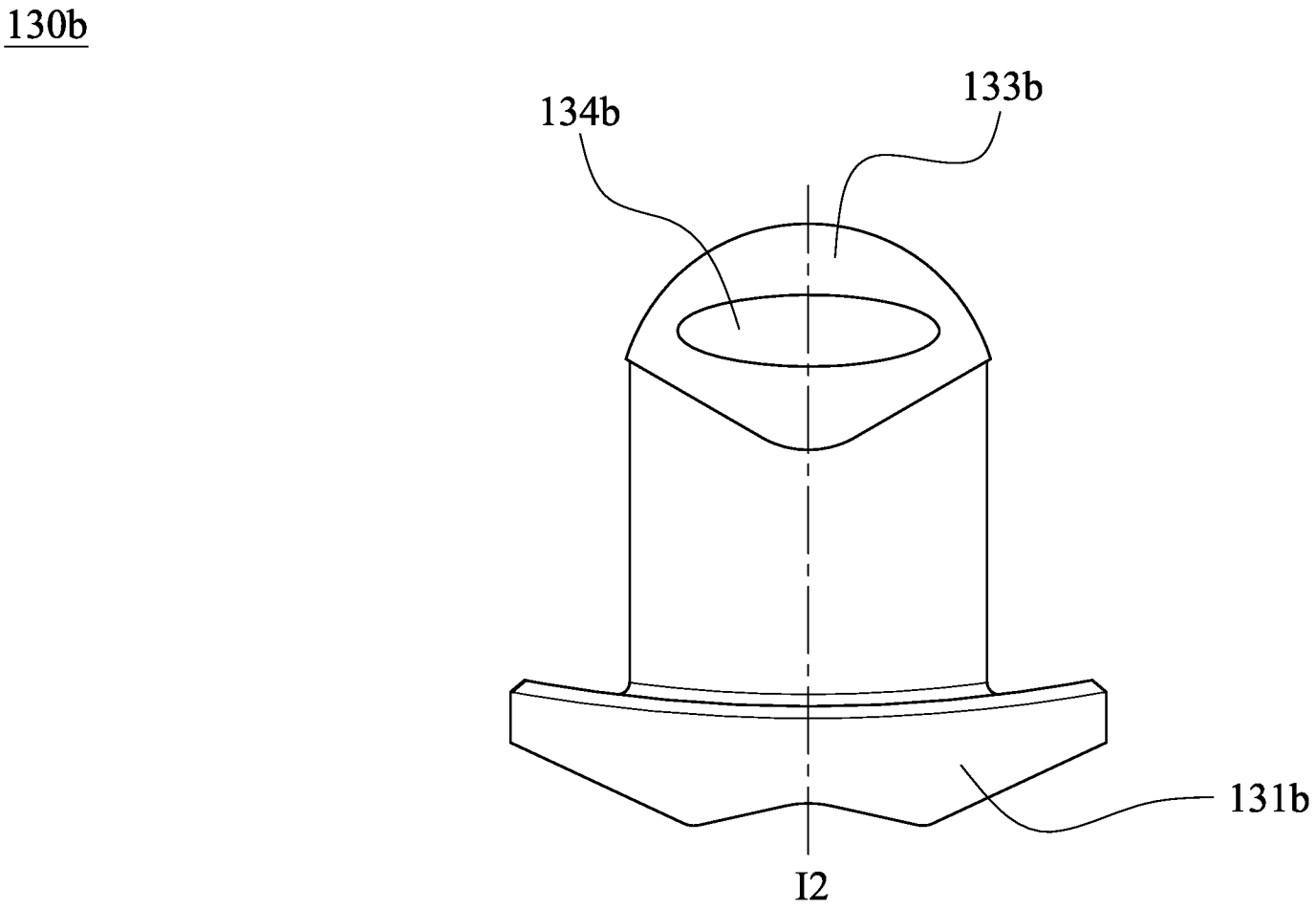
FIG. 9 is a front view of an elastic engaging member in the third embodiment as shown in FIG. 7.

Referring to FIG. 9 for a front view of an elastic engaging member 130*b* in the third embodiment as shown in FIG. 7, the engaging portion 133*b* of the elastic engaging member 130*b* has a generally semispherical shape. The gradually curved surface of the semi spherical structure provides the engaging portion 133*b* with a desirable guiding function. The through hole 134*b* of the elastic engaging member 130*b* penetrates the engaging portion 133*b* in the axial direction (not indicated by a reference numeral in FIG. 9) of the first fitting hole. The through hole 134*b* is in the shape of an elliptical cylinder, with the minor axis (not indicated by a reference numeral in FIG. 9) of the elliptical cross section of the elliptical cylinder parallel to a radial direction of the first fitting hole (i.e., parallel to the center line 12 of the elastic engaging member 130*b*) such that the engaging portion 133*b* is less resistant to deformation in the radial direction of the first fitting hole than to deformation in the axial direction of the first fitting hole. When a tool is inserted into the first fitting hole, the through hole 134*b* allows the engaging portion 133*b* to be deformed more easily in the radial direction of the first fitting hole than in the axial direction of the first fitting hole, thereby facilitating the docking of the tool. In addition, the head portion 131*b* of the elastic engaging member 130*b* is configured to protrude from the outer surface of the body 100*b* in the radial direction of the first fitting hole so that when the socket structure 10*b* is placed on a flat surface, the protruding head portion 131*b* can prevent the socket structure 10*b* from rolling.

While the present invention has been disclosed through the embodiments described above, it should be understood that the embodiments are not intended to be restrictive of the scope of the invention. A person skilled in the art shall be able to make various changes or modifications to the disclosed embodiments without departing from the spirit or scope of the invention. The scope of the patent protection sought by the applicant is defined by the appended claims.

What is claimed is:

1. A socket structure, comprising:

a body;

a first fitting hole disposed at a first end of the body;

a second fitting hole disposed at a second end of the body; and at least one elastic engaging member inserted into the body and protruding out in the first fitting hole along a radial direction of the first fitting hole, the at least one elastic engaging member having a through hole and an elliptical cross section, the through hole being exposed inside the first fitting hole;

wherein when a tool is inserted into the first fitting hole, the at least one elastic engaging member is pressed and deformed by the tool.

2. The socket structure of claim 1, further comprising at least one receiving hole in communication with the first fitting hole, the at least one elastic engaging member is inserted into the at least one receiving hole.

3. The socket structure of claim 2, wherein the at least one receiving hole comprises a large-diameter section and a small-diameter section connected to the large-diameter section, and the at least one elastic engaging member comprises:

a head portion disposed in the large-diameter section;

a neck portion connected to the head portion and disposed in the small-diameter section; and an engaging portion connected to the neck portion and protruding toward the inner portion of the first fitting hole along the radial direction of the first fitting hole;

wherein the engaging portion has a first cross section having a larger area than a second cross section of the neck portion.

4. The socket structure of claim 3, wherein the first cross section of the engaging portion comprises:

a major axis parallel to an axial direction of the first fitting hole; and a minor axis perpendicular to the major axis.

5. The socket structure of claim 3, wherein the at least one elastic engaging member further comprises:

the through hole disposed in the engaging portion; and a chamfer disposed at an end of the engaging portion that faces away from the head portion.

6. The socket structure of claim 3, wherein the engaging portion is generally semispherical.

7. The socket structure of claim 3, wherein the head portion protrudes from an outer surface of the body along the radial direction of the first fitting hole.

8. The socket structure of claim 3, wherein the number of the at least one receiving hole is three, and the three receiving holes are disposed at intervals along a periphery of the first fitting hole and extend along radial directions of the first fitting hole respectively; and wherein the number of the at least one elastic engaging member is three, and the three elastic engaging members are disposed in the three receiving holes respectively.

9. The socket structure of claim 8, wherein each said receiving hole is spaced apart from an end edge of the body by a distance in an axial direction of the first fitting hole, and the distances are different.

10. The socket structure of claim 1, further comprising a collar, wherein the collar is mounted around the body and is connected with the at least one elastic engaging member.

* * * * *